United States Patent [19]

Bauer et al.

[11] 4,424,664

[45] Jan. 10, 1984

[54] FRICTION FALSE TWIST APPARATUS

[75] Inventors: Karl Bauer; Heinz Schippers; Peter Dammann, all of Remscheid, Fed. Rep. of Germany

[73] Assignee: Barmag Barmer Maschinenfabrik AG, Remscheid, Fed. Rep. of Germany

[21] Appl. No.: 360,371

[22] Filed: Mar. 22, 1982

Related U.S. Application Data

[63] Continuation-in-part of Ser. No. 272,936, Jun. 12, 1981, which is a continuation-in-part of Ser. No. 168,734, Jul. 14, 1980, Pat. No. 4,339,915.

[30] Foreign Application Priority Data

| | | | |
|---|---|---|---|
| Jul. 14, 1979 | [DE] | Fed. Rep. of Germany | 2928522 |
| Jun. 26, 1980 | [DE] | Fed. Rep. of Germany | 3023887 |
| Jun. 15, 1981 | [DE] | Fed. Rep. of Germany | 3123671 |
| Nov. 17, 1981 | [DE] | Fed. Rep. of Germany | 3145513 |

[51] Int. Cl.[3] ..... D02G 1/08; D01H 7/92

[52] U.S. Cl. ..... 57/338; 57/340; 57/348

[58] Field of Search ..... 57/334–340, 57/348, 349

[56] References Cited

U.S. PATENT DOCUMENTS

| | | | |
|---|---|---|---|
| 2,863,280 | 12/1958 | Ubbelohde | 57/336 X |
| 3,156,084 | 11/1964 | Van Dijk et al. | 57/340 |
| 3,225,533 | 12/1965 | Henshaw | 57/340 X |
| 3,373,554 | 3/1968 | Raschle | 57/340 |
| 3,394,540 | 7/1968 | Bentov | 57/337 X |
| 3,488,941 | 1/1970 | Asaka | 57/340 X |
| 3,495,391 | 2/1970 | Njo | 57/340 |
| 4,050,229 | 9/1977 | Hayahusa | 57/340 X |
| 4,110,962 | 9/1978 | Schuster et al. | 57/339 |
| 4,145,871 | 3/1979 | Iwata et al. | 57/340 |
| 4,149,366 | 4/1979 | Bass et al. | 57/339 X |
| 4,339,915 | 7/1982 | Dammann et al. | 57/339 |

FOREIGN PATENT DOCUMENTS

| | | |
|---|---|---|
| 2001120 | 7/1971 | Fed. Rep. of Germany . |
| 2121917 | 8/1971 | France . |
| 1375380 | 11/1974 | United Kingdom . |
| 1421662 | 1/1976 | United Kingdom . |

*Primary Examiner*—John Petrakes

*Attorney, Agent, or Firm*—Bell, Seltzer, Park & Gibson

[57] ABSTRACT

A yarn false twisting apparatus is disclosed which comprises a pair of circular discs which are mounted for rotation about spaced apart axes, and such that portions of the surfaces are disposed in opposing face to face relation and define a twisting zone therebetween. In the operative position, one disc is resiliently deflected from its normal plane of rotation at the twisting zone by its engagement with the friction surface of the other disc, or a yarn passing therebetween, to thereby effectively engage and impart twist to the yarn. The bearing housings for the supporting shafts of the discs are held against movement with respect to each other during the twisting operation, and means are provided for automatically separating the housings and thus the discs in the event of a yarn breakage, to thereby avoid wear of the opposing disc surfaces.

14 Claims, 14 Drawing Figures

FRICTION FALSE TWIST APPARATUS

Figure 1A:
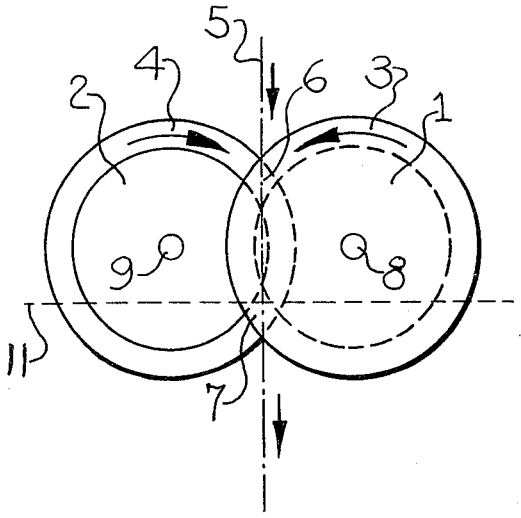

The present application is a continuation-in-part of copending application Ser. No. 272,936 filed June 12, 1981, which in turn is a continuation-in-part of copending application Ser. No. 168,734, filed July 14, 1980, now U.S. Pat. No. 4,339,915.

The above copending application Ser. No. 168,734 discloses a friction false twist apparatus for false twisting synthetic filaments in texturing machines, in which the yarn is twisted by nipping it between the front face of a rotating, flexible disc and an opposing surface on a second rotating disc or the like. The flexible disc is deflected by a pressure applying member acting directly upon the rear surface of the flexible disc, and such that the disc is locally biased in a direction toward the opposing surface and the yarn is nipped between an annular friction surface and the opposing surface in the area of the threadline.

The above friction false twist apparatus has opened new areas of application in false twist texturing, in particular for higher-denier yarns, and has made it possible to further increase texturing speeds at the same or increased crimp.

In copending application Ser. No. 272,936, there is disclosed an embodiment wherein a disc supported in a gimbal-type mount is utilized, and the pressure applying member acts upon the entire bearing assembly of the disc, rather than directly upon the disc (see also German Gebrauchsmuster No. 80 16 896).

In accordance with one aspect of the present invention, a further technical simplification is provided in that a flexible disc, including its bearing, can be firmly positioned in an operating position in such a manner that the annular yarn engaging friction surface of the flexible disc is resiliently biased against the yarn engaging friction surface of the opposing member. A pressure applying member resiliently operating on the back side of the disc, or a pressure applying member resiliently operating on the bearing housing thus need not be utilized. Also, the adjustment of the frictional forces acting on the yarn is simplified and made possible by the adjustability of a stop within wide ranges. As in the friction false twist apparatus disclosed in the parent applications, the present embodiment likewise has the advantage that the resiliently moved mass of the disc and, therefore, the forces of the moved mass, are so small that eccentricities of the friction surfaces, i.e. of the flexible disc or of the opposing member, can be balanced so quickly that they do not result in pulsations.

With the present invention, flexible discs may be used which are, in particular, springy and supported in a gimbal-type mount. In this connection, reference is made to the German application P No. 31 40 261.5. It is also possible to mount a flexible or even a rigid disc on its supporting shaft in rotational engagement with the shaft, while permitting relative movement in the axial direction and against spring force, and to thereby produce a resilient mobility of the disc relative to its shaft.

As a further embodiment of the present invention, the bearing of the opposing twist imparting member may be guided for movement in a direction essentially perpendicular to the front face of the flexible disc and such that it is held in its operating position, either rigidly or by a spring force. Special conditions of installation can make this embodiment preferable.

The present invention preferably also provides means whereby the bearing housing and/or the disc is disengageable from its operating position, especially when a yarn end is down. This serves to avoid having the two frictional surfaces rub against each other when a yarn is not present.

Figure 1:
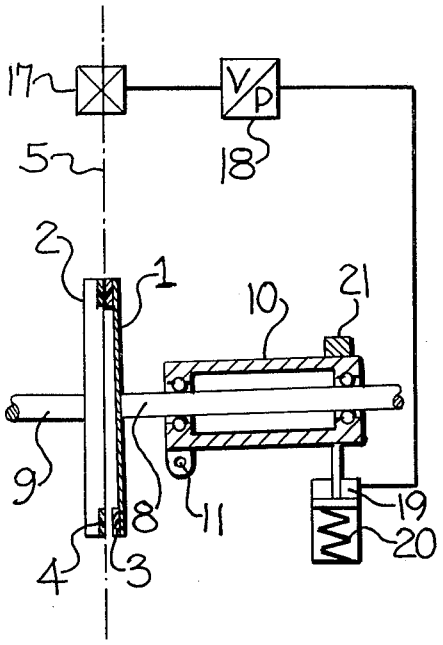

Some of the objects and advantages of the invention having been stated, others will appear as the description proceeds, when taken in connection with the accompanying drawings, in which FIG. 1 is a schematic side elevation view, partly sectioned, of a yarn false twisting apparatus embodying the present invention; and FIG. 1*a* is a schematic front elevation view of the apparatus shown in FIG. 1; and FIGS. 2–13 are views similar to FIG. 1, and illustrating other embodiments of the invention.

Referring more particularly to the drawings, in all illustrated embodiments, the friction false twist apparatus comprises a disc 1, which is resiliently movable relative to its shaft 8, and has an annular friction surface or ring 3. Disc 1 is mounted to rotate with the shaft 8 in a bearing housing 10, and it is driven in a non-illustrated manner in the direction indicated by an arrow in FIG. 1*a*. Further, the friction false twist apparatus includes an opposing member 2, which in the exemplified embodiments, is formed by the front face of rigid disc 2. Disc 2 is mounted on shaft 9 and rotates in the direction indicated by the arrow, which is opposite to that of disc 1. The friction surface 4 of this rigid disc 2 forms with the friction surface 3 of flexible disc 1 a nipping area or twisting zone 6, through which the yarn 5 is guided. In the illustrated embodiments according to FIGS. 1–11, the bearing (not shown) of disk 2 is stationary.

In the embodiment of FIG. 1, the disc 1 is relatively thin and readily flexible, and may be formed of a suitable elastomeric material. The bearing housing 10 for the flexible disc 1 pivots about axis 11, which extends in a direction transverse to the axis of shaft 8. The housing 10 is pressed by spring 20 against stop 21, so that the bearing is stationarily positioned in the operative position of disc 1. In the operative position, the peripheral portion of the disc 1 is resiliently deflected from its normal or free plane of rotation at the twisting zone by its engagement with the friction surface of the disc 2 or the yarn 5 passing therebetween. The force of spring 20 is adequate to resiliently maintain the disc 1 in such operative position. Any eccentricities in the discs 1 and 2, or their mountings, and which would result in non-uniform texturing of the yarn, are thereby quickly and sensitively balanced by the low-mass resilient mobility of friction ring 3, so that they do not affect the texturing result.

A yarn detector 17 is provided which emits an electric signal which is transformed to pneumatic pressure in the electropneumatic converter 18. When an end is down, this pressure acts via the cylinder-piston assembly 19, to pivot the bearing housing 10 about axis 11 and withdraw it from stop 21. Thereby, the frictional contact between friction rings 3 and 4 is discontinued or reduced, and damage to the friction rings is avoided.

It should be noted that the avoidance of damage to the friction rings can also be accomplished in a different manner, for example, by terminating the drive of the friction false twist apparatus. The advantage in such case would be that housing 10 need not be movable, and thus the need for the cylinder-piston assembly 19 and spring 20 could be avoided. Provided each friction false twist apparatus is operated by its own drive, housing 10 for flexible disc 1 could then be stationary and immobile, and the drive would be disconnected when an end is down. However, if a common drive for a plurality of friction false twist apparatus is provided, it is preferable, when a yarn breaks, to interrupt the frictional contact between friction rings 3 and 4 by the movement of bearing housing 10 as described above.

Figure 2:
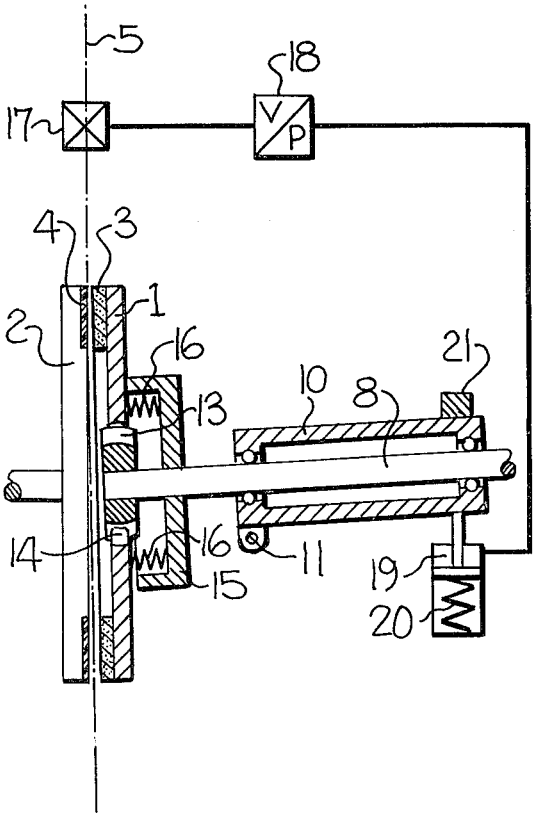

The embodiment shown in FIG. 2 differs from that in FIG. 1 only in the design of the disc 1 and its mounting to the shaft 8. Here, disk 1 is relatively rigid and is mounted to the shaft by a gimbal-like interconnection which permits the disc to freely incline with respect to the shaft. The interconnection includes a gear tooth system 13 and 14 on the shaft and disc respectively. A resilient support is provided by a support plate 15 which is fixed to the shaft, and the tension springs 16 which are interposed between the plate 15 and disc. Thus the tension springs 16 axially bias the disc 1 against disc 2. Otherwise, the mode of operation is identical to that described above with respect to FIG. 1.

It should be noted that, in the illustrated operating position, bearing housing 10 is stationarily positioned by resting against a stop, but it can also be positioned in a different manner. For example, an identation could be provided in which the bearing housing engages in its operating position, and from which it disengages when an end is down.

It should further be noted that in all illustrated embodiments, the axes of rotation of shafts 8 and 9 of discs 1 and 2 are spaced apart but appear to slightly intersect each other when viewed in side elevation, i.e., they are somewhat inclined with respect to each other and they cross in space. Therefore, the axis of rotation of shaft 8 of the disc 1 is not exactly perpendicular to, but slightly inclines toward, the opposing face of disc 2. Also, the friction surfaces of the discs define respective planes which are somewhat inclined with respect to each other.

Figure 3:
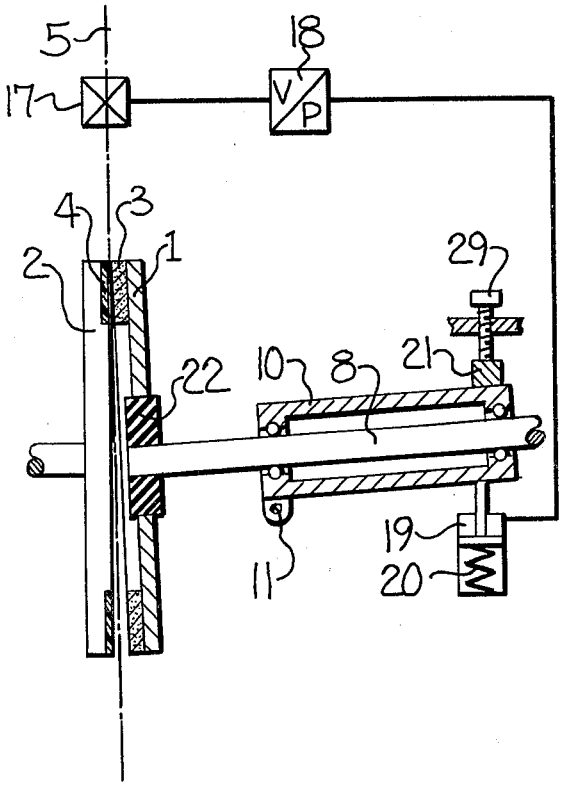

The embodiment shown in FIG. 3 differs from the previously described embodiments in that disc 1 is relatively rigid and is attached to a rubber-elastic hub 22 on shaft 8. In this case, the friction ring 3 is resiliently deflected from its normal or free plane of rotation relative to shaft 8 by its operative contact with the friction ring 4 of rigid disc 2 or yarn 5.

Figure 4:
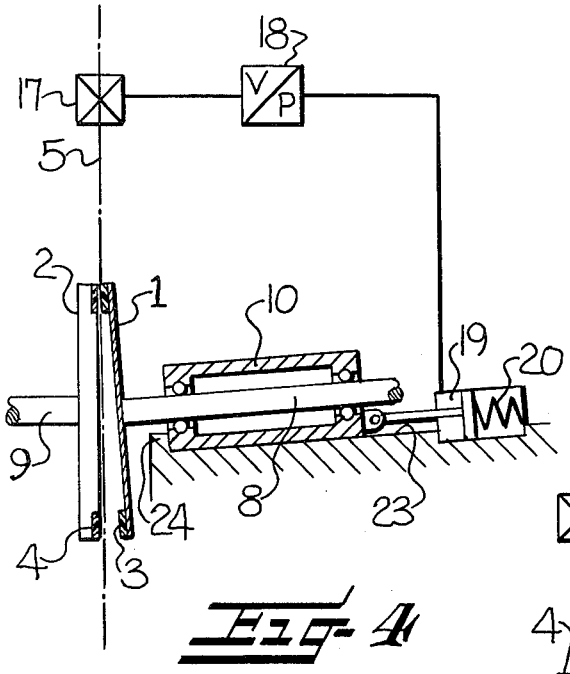
Figure 5:
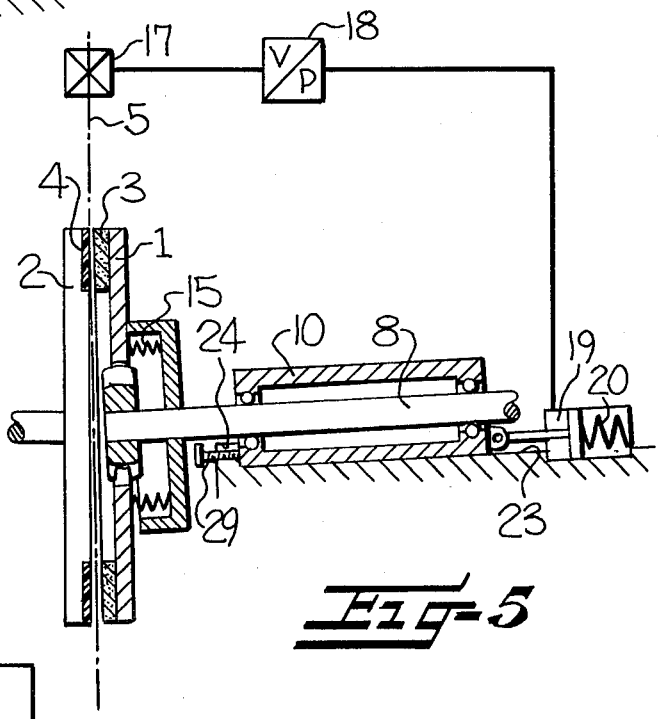
Figure 6:
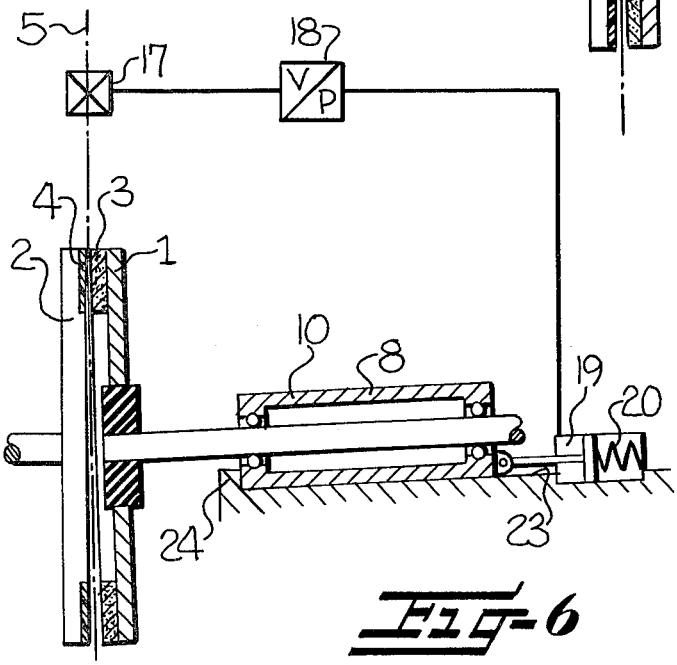

The embodiments shown in FIGS. 4, 5 and 6 correspond to those of FIGS. 1, 2 and 3 with respect to the design of the disc 1. However, bearing housing 10 of the disc 1 moves in a straight line on guideway 23. Spring 20 presses the bearing housing against a stop 24 in such a manner that friction ring 3 of the disc is deflected from its normal plane of rotation relative to the shaft by its contact with friction ring 4 or yarn 5. The stationary rigid position of bearing housing 10 against stop 24 is interrupted upon a yarn break, by the yarn detector 17, converter 18, and cylinder-piston assembly 19, and thus any frictional contact between friction rings 3 and 4 then terminates.

In the embodiment shown in FIGS. 1–6, the stationary positioning of the bearing housing during operation can be produced in other ways than by pressing it against a stop. For example, it can be produced by a locking engagement or any other means of fixation. Likewise, these embodiments make it possible to disengage housing 10 from its stationary operating position upon a yarn break by other steps, for example, by shutting down the friction false twist apparatus.

Advantageously, all embodiments preferably provide that the stop 21 or 24 can be effectively moved in a direction toward the housing and locked in different positions. This permits the highly sensitive adjustment of the contact pressure of friction ring 3 on yarn 5 or disc 2. As a specific example, the stop may include an adjustable spindle or set screw 29, note FIGS. 3 and 5. This adjustability of the stop makes it possible to sensitively adjust the yarn contact pressure.

Figure 7:
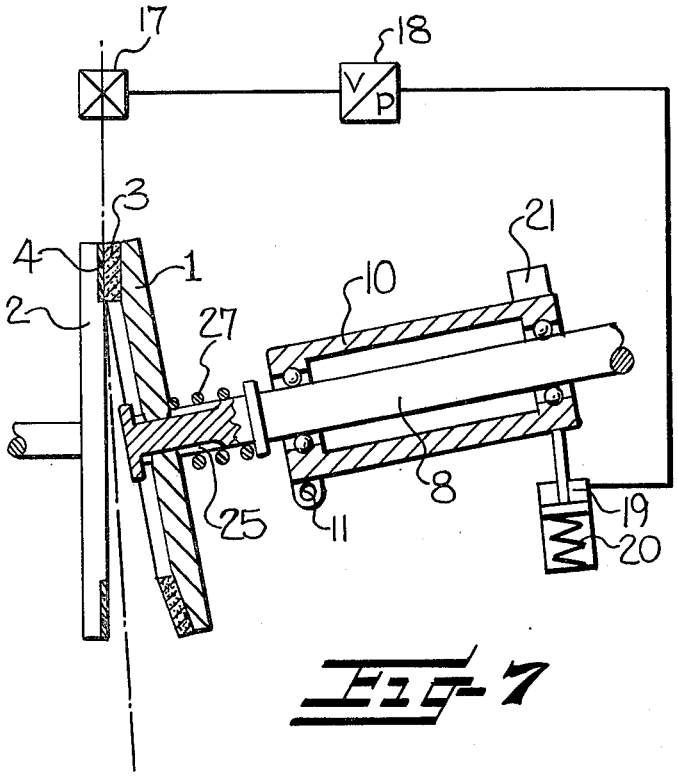
Figure 8:
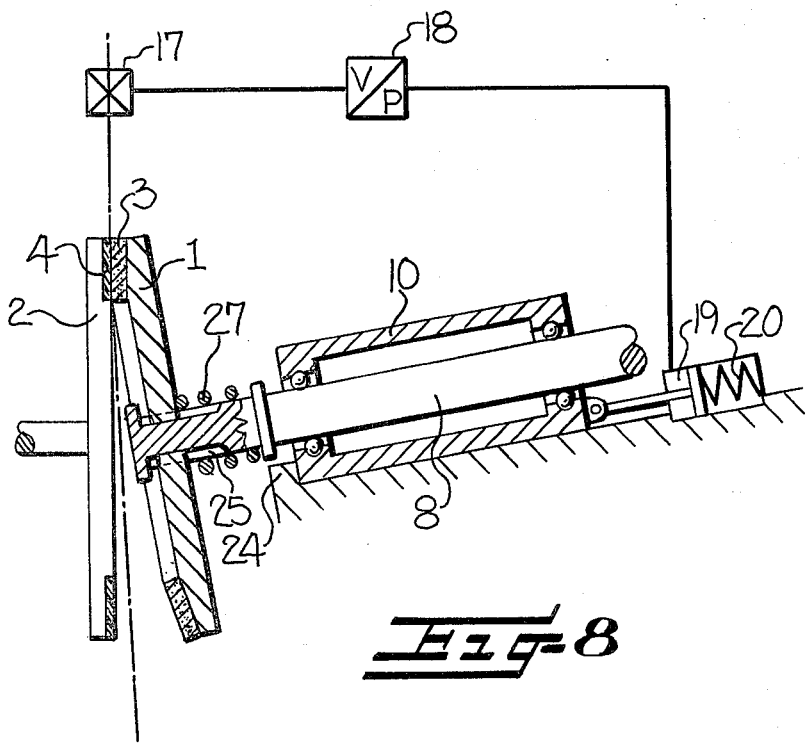

In the embodiments shown in FIGS. 7 and 8, bearing housing 10 is mounted in the same way as in the embodiments of FIGS. 1–3 and 4–6 respectively. However, the elastic mobility of disc 1 relative to its shaft 8 is accomplished in that disc 1, which is relatively rigid, is movable in the axial direction by means of a toothed interconnection 25 between shaft 8 and the hub of the disc, and against a spring 27. When a yarn end is down, frictional contact is again discontinued by disengaging housing 10 of the movable disc from its operation position by means of the detector 17, converter 18, and cylinder-piston assembly 19 as described above.

Figure 9:
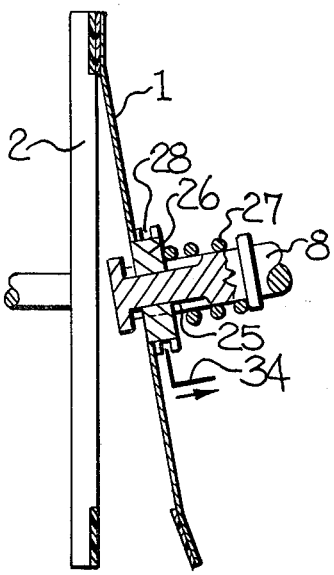
Figure 10:
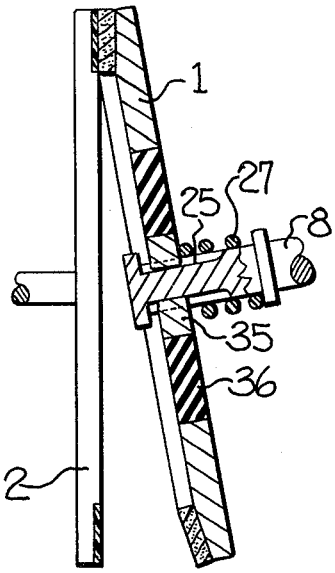

In the embodiment shown in FIG. 9, disc 1 moves axially in the manner described above, and it is pressed by spring 27 in a direction toward disc 2. More particularly, the disc is relatively thin and flexible, and it is mounted to a rigid hub 26. The hub 26 is in turn slideably mounted to the shaft by a toothed interconnection 25, and a spring 27 is provided for biasing the hub 26 and disc 1 toward the opposing rigid disc 2. The bearing housing can in this embodiment be mounted stationarily and immovably, since for disengagement upon a yarn break, hub 26 is provided with a circular groove 28, in which a carrier 34 is engaged. This carrier makes it possible, when an end is down, to discontinue the frictional contact between the friction surfaces by axially withdrawing disc 1 against the force of spring 27. In FIG. 10, the disc 1 includes a rigid hub 35 which is slideably mounted on the shaft, and an intermediate rubber-elastic portion 36. Thus the disc 1 is axially movable with respect to the shaft, and is biased toward the opposing disc by the spring 27.

Figure 11:
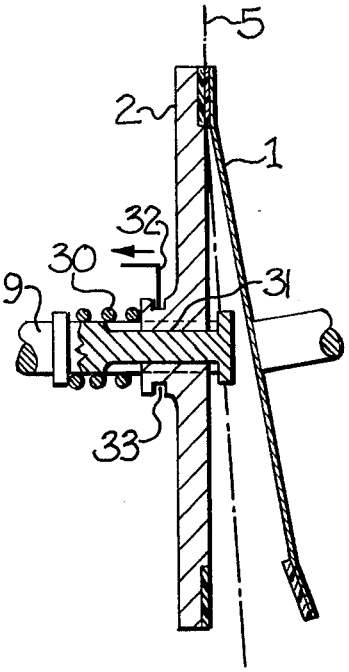

In the embodiment shown in FIG. 11, both the flexible disc 1 and its bearing housing (not shown) are stationarily supported. The contact pressure of disc 1 against the yarn and disc 2 is produced by guiding rigid disc 2 axially on its shaft 9 against the force of spring 30. A toothed interconnection 31 serves to transmit the torque to the disc 2. It can be seen that carrier 32 engaging in groove 33, is adapted to break the frictional contact when an end is down. Also, the bearing housing of disc 1 or disc 2 can be movably mounted more or less in a way as has been shown in the embodiments of FIGS. 1–6.

Figure 12:
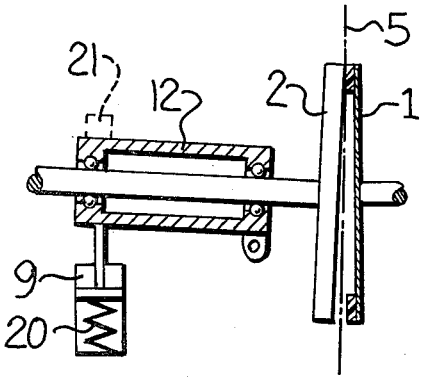
Figure 13:
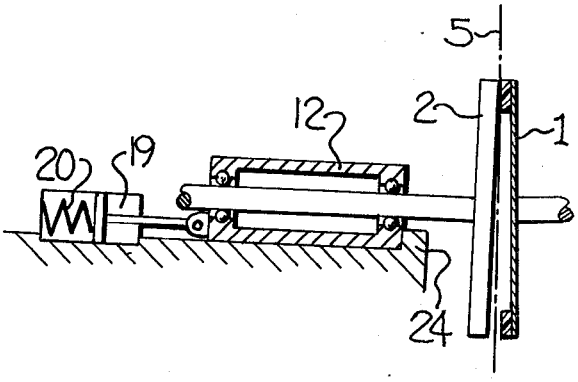

In the embodiments shown in FIGS. 12 and 13, the invention is modified to the extent that bearing housing 12 of the rigid disc 2 is so movable that the frictional contact can be discontinued upon a yarn break. In these cases, it is possible to press bearing housing 12 by the force of spring 20 elastically into its operating position or, to provide an essentially rigid stop 21 or 24, which accomplishes a stationary support in the operating position.

It should be emphasized that stationary in the sense of this application is not to be equated with rigid. Also, the elasticity and damping properties of the arrangements, which provide that the bearing housings of the opposing surface or flexible disc are held in their operating position, are determined by vibrational necessities.

In the drawings and specification, there has been set forth a preferred embodiment of the invention, and although specific terms are employed, they are used in a generic and descriptive sense only and not for purposes of limitation.

That which is claimed is:

1. A yarn false twisting apparatus comprising a pair of twist imparting members, with each member being mounted on a supporting shaft and including a yarn engaging friction surface, and at least one of said members comprising a readily flexible circular disc, means rotatably mounting said twist imparting members such that portions of the respective yarn engaging friction surfaces are disposed in opposing, face to face relationship and define a twisting zone therebetween, and with at least that portion of said flexible disc which includes said friction surface being resiliently deflected from its normal plane of rotation at said twisting zone by its engagement with the friction surface of the other member or a yarn passing therebetween, said mounting means including a bearing housing rotatably mounting each of the supporting shafts, means mounting at least one of said housings for movement in a direction wherein said friction surfaces may be moved toward and away from each other at said twisting zone, and stop means positioned for limiting said movement so as to limit the extent of the resilient deflection of said flexible disc, and drive means for operatively rotating each of said twist imparting members about their respective axes, whereby a yarn may be continuously advanced through said twisting zone while having twist imparted thereto by frictional contact between the yarn and the respective opposed friction surfaces.

2. The yarn false twisting apparatus as defined in claim 1 wherein said mounting means further includes means mounting said one bearing housing for pivotal movement about an axis extending in a direction transverse to the axis of said shaft, and means urging said shaft about said transverse axis.

3. The yarn false twisting apparatus as defined in claim 1 wherein said mounting means further includes means mounting said one bearing housing for movement in a direction generally parallel to the axial direction of the associated shaft.

4. The yarn false twisting apparatus as defined in claim 1 wherein said stop means is adjustable to thereby permit adjustment of the contact pressure by varying the relative positions of said discs and the extent of the resilient deflection of said flexible disc.

5. The yarn false twisting apparatus as defined in claim 1 wherein said mounting means further includes means for resiliently biasing said housing toward said stop means.

6. The yarn false twisting apparatus as defined in claim 1 further comprising yarn detection means for moving said one housing away from said stop means to separate the opposing friction surfaces upon a yarn break.

7. A yarn false twisting apparatus comprising a pair of twist imparting members, with each member being mounted on a supporting shaft and including a yarn engaging friction surface, and at least one of said members comprising a circular disc, means rotatably mounting said twist imparting members such that portions of the respective yarn engaging friction surfaces are disposed in opposing, face to face relationship and define a twisting zone therebetween, said mounting means including interconnection means mounting said disc to its associated shaft so as to permit the entire disc to freely incline with respect to the axis of said shaft, and such that the portion of said disc which includes said friction surface is resiliently deflected from its normal plane of rotation at said twisting zone by its engagement with the friction surface of the other member or a yarn passing therebetween, said mounting means further including a bearing housing rotatably mounting each of the supporting shafts, means mounting at least one of said housings for movement in a direction wherein said friction surfaces may be moved toward and away from each other at said twisting zone, and stop means positioned for limiting said movement so as to limit the extent of the resilient deflection of said disc, and drive means for operatively rotating each of said twist imparting members about their respective axes, whereby a yarn may be continuously moved through said twisting zone while having twist imparted thereto by frictional contact between the yarn and the respective opposed friction surfaces.

8. The yarn false twisting apparatus as defined in claim 7 wherein each of said twist imparting members comprises a relatively rigid circular disc.

9. The yarn false twisting apparatus as defined in claim 8 wherein said interconnection means comprises a gimbal-like interconnection interpose between said disc and its shaft.

10. The yarn false twisting apparatus as defined in claim 8 wherein said interconnection means comprises an elastomeric body member interposed between said disc and its shaft.

11. The yarn false twisting apparatus as defined in claim 9 or 10 wherein said mounting means further includes means mounting said one bearing housing for pivotal movement about an axis extending in a direction transverse to the axis of said shaft, and means resiliently urging said shaft about said transverse axis.

12. The yarn false twisting apparatus as defined in claim 9 or 10 wherein said mounting means further includes means mounting said one bearing housing for movement in a direction generally parallel to the axial direction of the associated shaft.

13. A yarn false twisting apparatus comprising a pair of twist imparting circular discs, with each of said discs being mounted on a supporting shaft and including a yarn engaging friction surface, and at least one of said discs being readily flexible, means rotatably mounting said twist imparting discs such that portions of the respective yarn engaging friction surfaces are disposed in opposing, face to face relationship and define a twisting zone therebetween, said mounting means including toothed interconnection means between a first disc and its supporting shaft for permitting relative axial movement therebetween while precluding relative rotational movement, and spring biasing means mounted between said first disc and its supporting shaft for biasing said disc axially toward the other disc, and such that at least that portion of said first disc which includes said friction surface is resiliently deflected from its normal plane of rotation at said twisting zone by its engagement with the friction surface of the other disc or a yarn passing therebetween, and drive means for operatively rotating each of said twist imparting discs about their respective axes, whereby a yarn may be continuously moved through said twisting zone while having twist imparted thereto by frictional contact between the yarn and the respective opposed friction surfaces.

14. A yarn false twisting apparatus comprising a pair of twist imparting circular discs, with each of said discs being mounted on a supporting shaft and including a yarn engaging friction surface, and at least one of said discs comprising a hub slideably mounted to its supporting shaft, a rigid outer portion, and an elastomeric portion disposed between said hub and said rigid outer portion, means rotatably mounting said twist imparting discs such that portions of the respective yarn engaging friction surfaces are disposed in opposing, face to face relationship and define a twisting zone therebetween, said mounting means including toothed interconnection means between said hub and its supporting shaft for permitting relative axial movement therebetween while precluding relative rotational movement, and spring biasing means mounted between said hub and its supporting shaft for biasing said one disc axially toward said other disc, and such that at least that portion of said one disc which includes said friction surface is resiliently deflected from its normal plane of rotation at said twisting zone by its engagement with the friction surface of the other disc or a yarn passing therebetween, and drive means for operatively rotating each of said twist imparting members about their respective axes, whereby a yarn may be continuously moved through said twisting zone while having twist imparted thereto by frictional contact between the yarn and the respective opposed friction surfaces.

* * * * *